United States Patent [19]

Radtke

[11] 4,033,275

[45] July 5, 1977

[54] METHOD OF FORMING AN OPENING TAB IN SHEET METAL CONTAINER END CLOSURES

[75] Inventor: Charles S. Radtke, Little Ferry, N.J.

[73] Assignee: American Can Company, Greenwich, Conn.

[22] Filed: Nov. 3, 1975

[21] Appl. No.: 628,501

[52] U.S. Cl. ..... 113/121 C; 113/1 F

[51] Int. Cl.[2] ..... B21D 51/40

[58] Field of Search ..... 113/1 F, 121 C, 15 A; 220/266, 268, 260, 265

[56] References Cited

UNITED STATES PATENTS

| | | | |
|---|---|---|---|
| 2,261,117 | 11/1941 | Jack | 220/268 |
| 3,888,199 | 6/1975 | Herrmann | 113/121 |
| 3,931,909 | 1/1976 | Dalli et al. | 113/121 |
| 3,948,415 | 4/1976 | Debenham | 113/121 |

*Primary Examiner*—Lowell A. Larson
*Attorney, Agent, or Firm*—Robert P. Auber; Ira S. Dorman; Paul R. Audet

[57] ABSTRACT

A bulge, formed in and cut from an end closure central panel, is reformed into an opening tab by reducing the bulge height and its sidewall angle to extend its brim horizontally outward under the rim of the opening from which the bulge is cut, and the brim is coined to further extend it under the rim. Alternatively, an outwardly extending shoulder can be formed in the bulge sidewall, and ironed out to cooperate with the reduction in bulge height in extending the bulge brim outward under the rim. During reforming and coining, the bulge/opening tab is held in a substantially horizontally fixed position relative to the rim to provide a uniform brim-to-rim underlap.

6 Claims, 13 Drawing Figures

FIG. 10
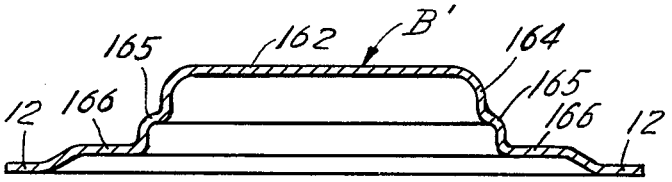
FIG. 11
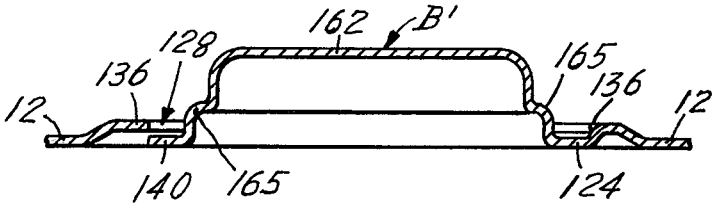
FIG. 12
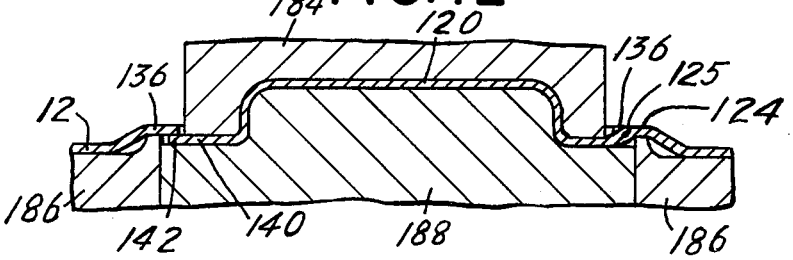
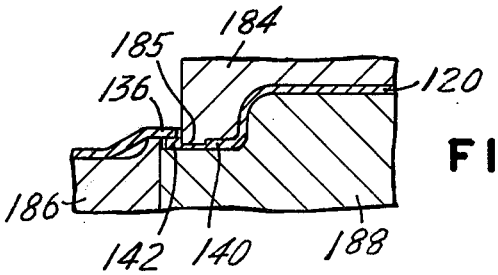
FIG. 13

METHOD OF FORMING AN OPENING TAB IN SHEET METAL CONTAINER END CLOSURES

BACKGROUND OF THE INVENTION

This invention relates to sheet metal end closures for containers. More particularly, this invention relates to methods of forming an opening tab in the central panel of a sheet metal easy open container end closure.

Recently, sheet metal container end closures, such as those interfoldedly seamed, as by a double seam, onto rims of beer and beverage containers, have been provided with non-removable opening devices. Instead of providing a pull tab attached to a score line-defined removable panel portion in the end closure central panel, a non-removable opening tab is provided which closes and is depressable through a pre-cut opening in the central panel. The opening tab typically is formed by stretching a portion of the central panel, as by forming a bulge therein, cutting substantially the entire bulge from the central panel to leave an integral panel-to-bulge connecting hinge and to form an opening in the panel, vertically displacing the bulge marginal edge portion below the rim of the opening, and completely flattening the bulge into an opening tab, and/or working the rim, to move the tab marginal edge or the rim or both relative to one another, such that portions of the tab marginal edge underlap the rim. This method of forming the opening tab and underlap and the use of a suitable sealant material along the underlap is designed to provide a tab-to-rim hermetic seal and to prevent the tab from being blown off the end closure by container internal pressures which, for container products such as beer and carbonated beverages can be at least about 95 psi.

However, the aforementioned method does not provide a tab that performs as desired. One of the main reasons is that it has been difficult to obtain a uniform underlap between all peripheral portions of the tab marginal edge and the rim of the opening. When the bulge is flattened and/or the opening rim is worked such as by being raised from the central panel and then partially flattened, the centerpoint of the opening tab becomes horizontally displaced relative to the center point of the opening, and there is more underlap in the direction of displacement than in the direction from which the displacement occurred. For example, when the underlap between the rim of a circular opening and the marginal edge of an integral hinge-connected circular opening tab is obtained by flattening the rim, the hinge also tends to be flattened. Flattening the hinge horizontally displace the tab away from the hinge and sometimes causes excessive underlap diametrically opposite the hinge, and insufficient underlap adjacent the hinge. This causes tab blow offs, and leakers adjacent the hinge. Attempts to overcome this tab-to-rim displacement and non-uniform underlap problem have involved providing excessive underlap, i.e. more than is really needed, along the entire tab edge periphery to insure that even with the displacement, there will be sufficient underlap adjacent the hinge. However, providing this excessive underlap involves a waste of sheet metal material.

An object of this invention is to overcome the aforementioned and other problems by providing a method of forming an opening tab for closing an opening in the central panel of a sheet metal end closure wherein a bulge having a brim is formed in and cut from the central panel, the bulge is reformed into an opening tab by reducing the bulge height and the angle of its sidewall relative to the horizontal, and the opening tab brim is coined to further extend its periphery substantially horizontally outward such that it further underlaps the rim of the central panel opening.

Another object of this invention is to overcome the aforementioned and other problems by providing a method of forming an opening tab for closing an opening in the central panel of a sheet metal end closure wherein a bulge having an outwardly extending shoulder and a brim is formed in and cut from the central panel, the bulge is reformed into an opening tab by reducing the height of the bulge and ironing out the shoulder, to extend the brim periphery substantially horizontally outward such that it underlaps the rim.

Another object of this invention is to provide the aforementioned method wherein in addition to reforming the bulge into an opening tab, there is added the step of coining the brim to extend it further under the rim.

Another object of this invention is to provide the aforementioned methods which provide a uniform underlap of the tab marginal edge and the rim of the central panel opening.

Another object of this invention is to provide the aforementioned methods and uniform underlap which minimize tab blow offs and leakers and prevent wastage of sheet metal material.

BRIEF DESCRIPTION OF THE DRAWINGS

FIG. 4 shows a bulge formed in a portion of the end closure of FIG. 3.

FIG. 5 shows the bulge of FIG. 4 after a first reforming.

FIG. 6 shows the bulge of FIG. 5 mostly cut from but hingedly-connected to the central panel.

FIG. 8 shows an opening tab formed by reforming and coining the bulge of FIG. 6.

FIGS. 10–13 are enlarged cross sections, with portions broken away, showing steps employed in an alternative embodiment of the method of this invention. FIG. 10 shows a bulge having a shoulder therein.

FIG. 11 shows the bulge of FIG. 10 cut from but hingedly-connected to an end closure central panel.

FIG. 12 shows an opening tab obtained by reforming the bulge of FIG. 11.

FIG. 13 shows the step of coining the opening tab brim of FIG. 12.

DETAILED DESCRIPTION

Figure 1:
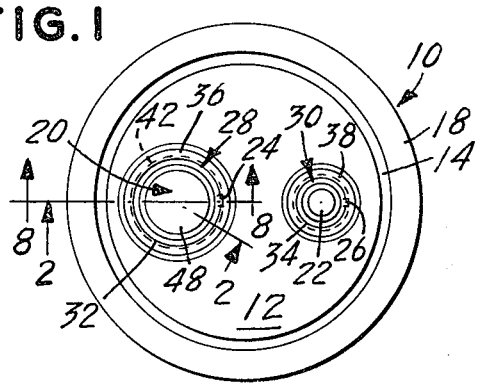
FIG. 1 is a top view of a sheet metal container end closure having opening tabs made according to the method of this invention.

Referring to the drawings in detail, FIG. 1 shows the top of a sheet metal container end closure, generally designated 10, of the type secured or interfoldly seamed, as by a double seam, onto the rim of a beer and beverage container (not shown). End closure 10 has a preferably generally planar central panel 12, surrounded by a contiguous, peripheral, recessed, U-shaped reinforcing groove 14 (FIG. 3), which merges with a peripheral, upwardly-extending countersink wall 16, which in turn merges with and terminates in a contiguous arcuate flange 18 whose hook portion becomes part of the seam which secures the end closure to a container body (not shown). End closure 10 can be formed of any suitable sheet metal material, including aluminum and steel, and it can be of any suitable shape, depending of course on the shape of the can body to which it is secured.

End closure 10 is provided with opening tabs 20, 22 formed of, and integrally hingedly-connected by hinges 24, 26 to, central panel 12. As will be explained, opening tabs 20, 22 are cut from, and close, seal and are depressable through openings 28, 30 defined by edges 32, 34 of respective central panel rims 36, 38. Opening tab 22 is depressable through opening 30 for venting container internal pressures prior to depressing the larger opening tab 20 to allow the packaged contents such as liquid to be poured through the larger opening 28. Although opening tabs 20, 22 and openings 28, 30 are shown as circular, and although they are diametrically aligned, they can be of any suitable size and shape such as teardropped and they can be in any suitable location. Although there is no criticality in the absolute size of opening 28, desirably, it is not so large as to permit complete insertion of a user's finger, yet it should be large enough to permit adequate out-flow of container contents. Sufficient undisturbed sheet metal remains between the radially extreme portion of openings 28, 30 and the periphery of central panel 12 to provide structural integrity that precludes buckling of the periphery of the opening due to high container internal pressures such as provided in beer and beverage containers.

Figure 2:
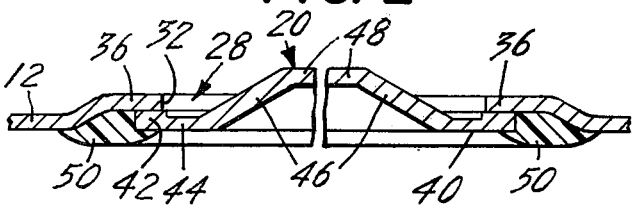
FIG. 2 is an enlarged cross section, with portions broken away, taken along line 2—2 of FIG. 1.

FIG. 2 is an enlarged cross section, with portions broken away, taken along line 2—2 of FIG 1. More particularly, FIG. 2 shows that opening tab 20 has a brim portion 40 having an underlapping portion 42 and a coined portion 44 which merges into a conically shaped upwardly extending sidewall 46, which in turn merges into topwall 48 which preferably is generally planar to central panel 12. Topwall 48 is raised from central panel 12 but it is substantially below the level of flange 18 (FIG. 3) to insure against unintentional depression of opening tab 20. Brim underlapping portion 42 extends substantially horizontally under and underlaps a marginal edge portion of rim 36 to close and seal opening 28. Rim 36 can be planar with central panel 12, but preferably it is raised therefrom to provide a well, when the end closure is inverted, for receiving and facilitating the application of a sealant means 50 to the underlap area for providing a hermetic, pressure resistant seal capable of withstanding internal pressures of at least 95 psi, as required for container end closures for beer and carbonated beverage containers. Although container internal pressures may be relied upon to maintain contact between brim underlapping portion 42 and rim 36, it is most desirable to utilize a sealant means 50 for cooperating with the underlapping brim portion and the rim to effect a hermetic seal of opening 28. Sealant means 50 can be any suitable means or material such as a sealing compound, plastic tape, adhesive foil, hot-melt material, combination thereof, etc. An example of a suitable sealing compound is a plastisol-grade polyvinyl chloride combined with a conventional plasticizer and compounding ingredients. This plastisol is heat curable to form a non-tacky, somewhat yieldable solid material that retains the tab in place and maintains a hermetic seal under pressures of the magnitudes which normally occur in cans of carbonated and malt beverages. Sealant means 50 must be sufficiently frangible to be ruptured upon application of manual pressure against opening tab 20, following release of internal pressures vented through opening 30. When, as shown, opening tab 20 and opening 28 are of circular configuration, sealant means 50 is applied as an annular ring. Opening tab 22 and rim 38 are of similar configuration but of substantially smaller area than the just described opening tab 20 and opening 28. Although the smaller of the opening tabs, here 22, must be depressed first to vent container pressures, each tab 20, 22 is similarly depressable through respective openings 28, 30 by applying pressure on upper portions thereof such that their respective hinges flex to allow the tab brims to tear through sealant means 50 and to allow the tab nonhinged portions to be depressed angularly into the container body (not shown) to which the end closure is secured.

Figure 3:
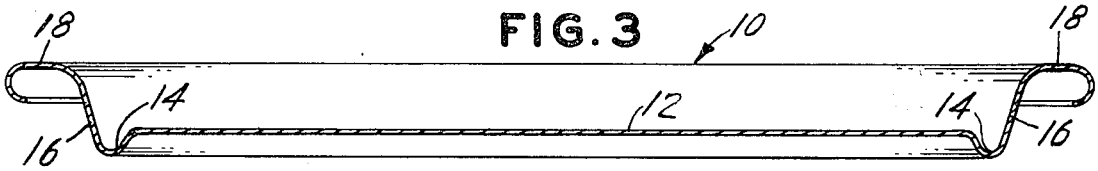
FIG. 3 is an enlarged cross section through a container end closure having a substantially planar central panel.

FIG. 3 is an enlarged cross section through a container end closure 10 having a substantially planar central panel 12 in which opening tabs will be formed according to the methods of this invention.

Figure 4:
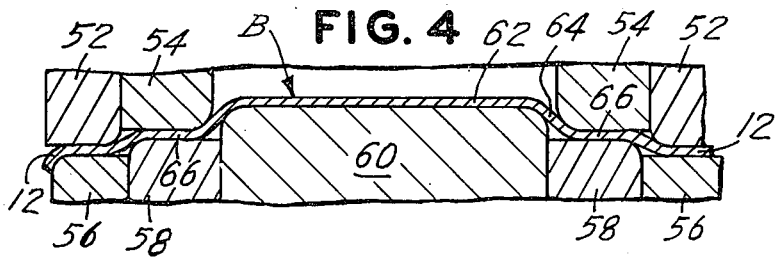
FIGS. 4–6 and 8 are enlarged cross sections, with portions broken away, showing steps employed in the preferred method of this invention.

FIGS. 4–6 and 8 are enlarged cross sections, with portions broken away, showing steps employed in the preferred method of this invention. More particularly, FIG. 4 shows that a blister or bulge B of suitable shape and dimensions is formed in central panel 12 of FIG. 3 by use of substantially annular upper dies 52, 54 and lower dies 56, 58 and 60, to stretch sheet metal of which the bulge is formed. Bulge B includes a top wall 62 which merges into an annular conical sidewall 64 which need not have but preferably has, about its base, a peripheral, substantially annular step 66 formed of and vertically displaced from central panel 12.

Figure 5:
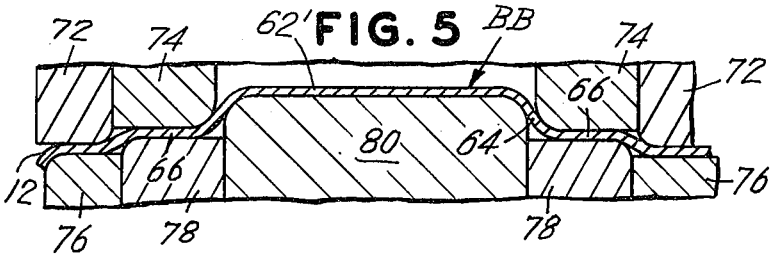

In FIG. 5, upper reforming dies 72, 74, cooperate with lower reforming dies 76, 78 and 80 to reform bulge B of FIG. 4 into a second bulge generally designated BB. The conical sidewall 64' of second bulge BB extends upwardly at a greater angle, relative to the horizontal, than does sidewall 46 of opening tab 20 of FIGS. 2 and 8.

Figure 6:
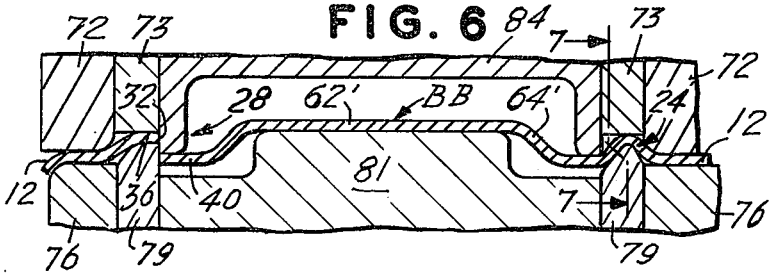

FIG. 6 shows that upper dies 72, 73 and lower dies 76, 79 and 81 retain and maintain portions of central panel 12 in a relatively fixed position as vertically moveable upper cutting die 84 cuts through central panel 12 radially outward of and almost entirely about bulge BB to leave integral connecting hinge 24 between the central panel and bulge, to provide the bulge with an integral peripheral brim generally designated 40 formed of a radially inner annular portion of step 66, and to provide central panel 12 with an opening 28 defined by edge 32 of rim 36 formed by a radially outer annular portion of step 66 of FIG. 5. Reformed sidewall 64' in FIG. 6 preferably is substantially the same angle as it was in FIG. 5. Brim 40 is displaced below the plane of rim 36 for the reforming operation shown in FIG. 8.

Figure 7:
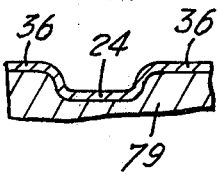
FIG. 7 is a cross section, with portions broken away and portions not shown, take along line 7—7 of FIG. 6.

As also shown in FIG. 7, a cross section taken substantially along line 7—7 of FIG. 6, a panel-to-bulge or opening tab connecting hinge 24, is formed out of raised step 66. Hinge 24 includes an indented or depressed portion which extends below the step plane. The remainder of the step is maintained in a raised position by lower reforming die 79.

Figure 8:
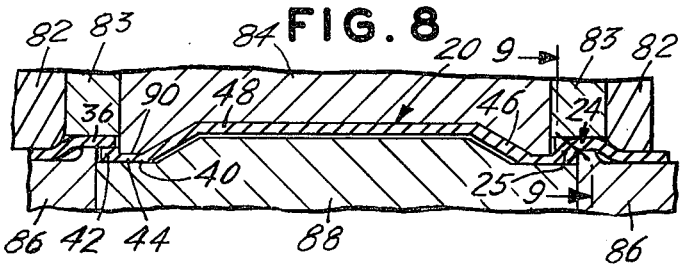

FIG. 8, an enlarged cross section taken along line 8—8 of FIG. 1, shows that bulge BB of FIG. 6 is reformed into opening tab 20 by upper reforming dies 82, 83 and upper reforming and coining die 84, in cooperation with lower reforming dies 86, 88. The upper and lower reforming dies of FIG. 8 reform bulge BB of FIG. 6 into opening tab 20 by reducing the height of bulge BB, by changing the slope of sidewall 64' into sidewall 46 which extends upwardly at less of an angle, relative to the horizontal, than sidewall 64' of bulge BB, and thereby moving the marginal edge portion of brim 40 substantially horizontally outward such that brim underlapping portion 42 underlaps the marginal edge of central panel rim 36. This reforming action occurs during the upper major portion of the downward stroke of upper reforming die 84. At the lowermost portion of the stroke, a radially inner portion of brim 40 is coined by the substantially annular lower, peripheral, coining portion 90 of reforming die 84, to form a coined brim area 44. This coining action further extends the periphery or outer marginal edge portion of brim 40 substantially horizontally further outward such that it increases the extent of underlap rim 36. These reforming and coining steps effected by die 84 cooperate such that the extent of the underlap is capable of providing, with sealant means 50 (FIG. 2), a hermetic brim-to-rim seal capable of resisting container internal pressures of at least about 95 psi. It is to be noted, that during the reforming and coining steps illustrated by FIG. 8, the upper and lower reforming dies, particularly 84 and 88 hold bulge BB while it is being reformed into an opening tab and hold the opening tab so reformed therefrom (hereafter bulge BB/opening tab 20) in a (laterally i.e., usually horizontally) fixed position relative to the central panel rim 36 to thereby insure against and prevent horizontal displacement of bulge BB/opening tab 20 and provide a uniform underlap between all portions of opening tab brim underlap portion 42 and central panel rim 36. FIG. 8 shows that because opening tab 20 is so held, it remains in concentric relation with respect to rim 36 while brim 40 is radially outwardly extended by the reduction in height of the bulge opening tab and the decrease in its side wall angle. As the angle of the bulge sidewall is reduced relative to the horizontal to form gradually sloping conical sidewall 46 and as brim 40 is radially outwardly extended, hinge 24 tends to thicken and/or pucker as at 25. The thickening and/or puckering accommodate any radially outward extension of hinge 24 and to thereby insure against horizontal displacement of opening tab 20 relative to rim 36. Although it is not shown in FIG. 8, FIG. 2 shows that the extent of underlap as represented by radial distance from edge 32 of rim 36 to the edge of opening tab brim 40 is uniform for all brim and rim portions.

Figure 9:
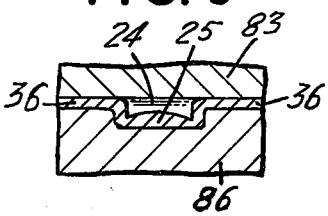
FIG. 9 is a cross section, with portions broken away, taken along line 9—9 of FIG. 8.

FIG. 9, a cross section with portions broken away taken along line 9—9 of FIG. 8, shows another view of the thickening and/or puckering of hinge 24 at 25. The space between respective upper and lower reforming dies 83, 86 allows for thickening and/or puckering to take place.

FIGS. 10, 11 and 12 are enlarged cross sections with portions broken away which show an alternative embodiment of the method of this invention. FIG. 10 shows that a bulge, generally designated B', is formed out of a container end closure central panel such as designated 12 in FIG. 3, in a manner that bulge B' has a top wall 162 which merges into a sidewall 164 having a radially outwardly extending temporary shoulder 165 therein, which in turn merges into a substantially annular step 166 vertically displaced from central panel 12. Step 166 of bulge B' is interrupted by indented and depressed portions which, like those shown in FIGS. 6 and 7, form a panel-to-bulge or opening tab connecting hinge 124. Bulge B' and its temporary shoulder 165 are formed to stretch the sheet metal of which the respective bulge and shoulder are formed. Although they are not shown, suitable cooperative upper and lower dies comparable to those employed in FIGS. 4 through 7, are employed for forming bulge B' of FIGS. 10 and 11.

FIG. 11 shows that central panel 12 is cut radially outward of temporary shoulder 165 almost entirely thereabout, to leave an integral connecting hinge 124 between central panel 12 and bulge B', to provide the bulge with an integral peripheral brim generally designated 140, formed of a radially inner portion of the step and, which, except for hinge 124, extends all the way around bulge B', and to provide central panel 12 with an opening 128 defined by the edge of raised rim 136 formed of a radially outer portion of the step. FIG. 11 shows that brim 140 is displaced below the plane of rim 136 for the reforming operation shown in FIG. 12.

FIG. 12 shows that bulge B' of FIG. 11 is reformed by the cooperation of upper reforming die 184 and lower reforming dies 186 and 188, into an opening tab 120 by reducing the height of bulge B' and by utilizing upper reforming die 184 in cooperation with lower reforming die 188 to iron out temporary shoulder 165 of FIG. 11. The reduction height of bulge B' and the ironing out of temporary shoulder 165 move brim 140 substantially horizontally outward such that a marginal edge underlapping portion 142 underlaps the marginal edge portion of rim 136 to an extent that provides, with sealant means such as 50 (FIG. 2) applied thereto, a hermetic brim-to-rim seal capable of resisting container internal pressures of at least about 95 psi. Upper and lower reforming dies 184, 186, 188 are utilized cooperatively for holding bulge B'/opening tab 120 in a horizontally fixed position relative to rim 136 to thereby prevent horizontal displacement of the bulge/opening tab and to thereby provide a uniform underlap between tab brim underlapping portion 142 and rim 136.

As shown in FIG. 13, if and as desired, brim 140 can be coined with suitable means such as coining portion 185 of upper reforming die 184' to further extend the periphery of brim 140, i.e. its marginal edge underlap portion 142, substantially horizontally further outward such that it further underlaps rim 136. The coining can be effected simultaneously with the reforming step of FIG. 12, as in FIG. 8, or as shown in FIG. 13, it can be effected as a separate step. Whether it is done simultaneously or as a separate step, the reforming and coining operations cooperate to provide a hermetic brim-to-rim seal capable of withstanding container internal pressures of at least 95 psi. As previously mentioned with respect to the preferred method, upper and lower reforming dies 184' and 188 cooperate to hold opening tab 120 in a substantially fixed position relative to rim 136 to thereby prevent horizontal displacement of bulge B'/opening tab 120 and to thereby provide a uniform underlap between brim 140 and rim 136.

The underlaps of brims 40 and 140 under rims 36 and 136 are obtained mainly during the reforming step of this invention wherein a bulge of suitable shape is reduced in height, and, wherein, with respect to the preferred method shown in FIGS. 4–9, the angle of the upper slope of the sidewall is reduced. This reduction in height, and reduction in sidewall angle, effect the extension of the outer marginal edge of brims 40, 140 under the marginal edges of rims 36, 136. Because the reforming step extends the brim under the rim, the coining step in the preferred or alternative method need not be and is not as severe as it would have to be if only coining (no reforming) were relied on to provide the sufficient brim-to-rim underlap. If coining alone were relied on, the coining would have to be so severe that edge splitting would occur due to insufficient metal elasticity at the brim periphery or marginal edge, and the edges would be rendered so thin and weak that they would crack and result in tab blow offs and leakers due to super-atmospheric container internal pressures. According to the method of this invention however, coining alone is not relied on, any coining done is not severe and the consequent radial outward extension of the brim marginal edge is in addition to that obtained during reforming.

According to the alternative method shown in FIGS. 10–13, the reforming includes a reduction in height of bulge B′ and, instead of a reduction in the sidewall angle relative to the horizontal, an ironing out of the temporary shoulder provided in the bulge sidewall. The stretched sheet metal provided in the shoulder usually provides sufficient brim-to-rim underlap, although coining can provide additional underlap as desired.

According to the methods of this invention, the bulges cut from central panel 12 can be of any suitable shape. If the preferred method shown in FIGS. 4–9 is employed, the bulge height must be higher than and its sidewall slope steeper than those of opening tab 20. If the alternative embodiment of the method shown in FIGS. 10–13 is employed, the bulge cut from central panel 12 must be higher than opening tab 120 and temporary shoulder 165 must be of a configuration such that when it is ironed out, it will provide the sufficient desired outward extension and brim-to-rim underlap.

The number and nature of steps employed to obtain the desired bulge size, shape and configuration that is cut from central panel 12 and reformed and/or coined, can and will vary depending on the final size and shape of the opening tab, on the type, temper, and thickness of the sheet metal employed. Although the method shown in FIGS. 4–9 is preferred for forming larger opening tab 20 and although such method can be employed for forming smaller opening tab 22, it has been found that instead of the steps and configurations formed and shown in FIGS. 4 and 5, an arcuately shaped blister or bulge of suitable height can be formed in one step, cut from central panel 12 and then reformed and/or coined into an opening tab 22 whose shape is similar to that of, but whose size is smaller than, opening tab 20 of FIG. 8. It has been found that the method shown in FIGS. 4–9 is successful for forming opening tab 20 out of the central panel of a container end closure made of 5182 weight aluminum plate, whose temper is H-19 on the Rockwell Hardness Scale and whose initial thickness (FIG. 3) is about 0.0125 inch. The method steps shown in FIGS. 4–9 have provided a uniform 0.015 underlap of brim 40 under rim 36, of which 0.012 inch is typically effected by the reforming step of FIG. 8, and the remaining the 0.013 inch by coining. Such a 0.015 inch uniform underlap provides highly satisfactory hermetic closings and seals which withstand and hold beer and beverage container internal pressures of at least 95 psi. Although the method shown in FIGS. 4–9 is preferred for forming opening tabs in container end closures made of aluminum, the alternative method shown in FIGS. 10–13 is believed highly suitable for container end closures made of steel.

It is thought that the invention and many of its attendant advantages will be understood from the foregoing description, and it is apparent that various changes may be made in the steps of the method and in the manner of their effectuation, without departing from the spirit and scope of the invention or sacrificing all of its material advantages, the methods and materials hereinabove described being merely preferred embodiments thereof.

I claim:

1. A method of forming a tab for closing an opening in the panel of a metal end closure for a container, which comprises:

deforming a portion of said panel to form therein an outwardly projecting bulge having a sidewall portion thereon;

severing said panel substantially entirely about said bulge to produce a tab with a free edge brim portion adjacent the base of said sidewall portion, a narrow, integrally-formed hinge portion connecting said tab to the remainder of said panel, and an opening in said panel defined by a rim portion thereon;

displacing at least said brim portion of said tab to dispose said brim portion inwardly of said rim portion of said panel; and reforming said tab to partially collapse said bulge and to thereby displace said brim portion laterally to a position underlapping said rim portion, said reforming step being effected with mating dies including a male member having a part thereon which is dimensioned and configured to conform closely to at least a part of said sidewall portion of said bulge, so that upon contact of said die and bulge parts the male member will constrain said tab against lateral shifting relative to said opening of said panel, said male member being configured to displace said brim portion to said underlapping position while maintaining the unshifted position of said tab, whereby a substantially uniform underlap is produced.

2. The method of claim 1 wherein said deforming operation produces about said bulge a peripheral step intermediate the outermost part of said bulge and the undeformed part of said panel, wherein severance of said panel occurs through said step, so that said brim is formed from the portion of said step adjacent said bulge and said rim is formed from the portion of said step adjacent said undeformed part of said panel.

3. The method of claim 1 wherein said sidewall portion of said bulge is tapered in an outward direction, and wherein the taper of said sidewall is reduced during said reforming operation.

4. The method of claim 1 wherein said sidewall portion is formed with a peripheral shoulder extending entirely thereabout, and wherein said shoulder is flattened during said reforming operation.

5. The method of claim 1 additionally including the step of coining said brim portion to increase the lateral displacement thereof, while maintaining the unshifted position of said tab on said male member.

6. The method of claim 1 additionally including the step of applying sealant means upon substantially the entire peripheral edge of said brim portion, to afford an hermetic brim-to-rim seal capable of resisting pressures of at least about 95 psi.

* * * * *